US007699099B2

(12) United States Patent
Bolding et al.

(10) Patent No.: US 7,699,099 B2
(45) Date of Patent: Apr. 20, 2010

(54) MODIFIED CHRISTMAS TREE COMPONENTS AND ASSOCIATED METHODS FOR USING COILED TUBING IN A WELL

(75) Inventors: Jeff Bolding, Kilgore, TX (US); Thomas G. Hill, Jr., Conroe, TX (US)

(73) Assignee: B.J. Services Company, U.S.A., Houston, TX (US)

( * ) Notice: Subject to any disclaimer, the term of this patent is extended or adjusted under 35 U.S.C. 154(b) by 307 days.

(21) Appl. No.: 11/461,858

(22) Filed: Aug. 2, 2006

(65) Prior Publication Data

US 2008/0029271 A1 Feb. 7, 2008

(51) Int. Cl.
*E21B 19/02* (2006.01)

(52) U.S. Cl. ..... 166/89.1; 166/88.1; 166/88.4; 166/75.11; 166/97.5

(58) Field of Classification Search ..... 166/97.5, 166/88.1, 88.4, 89.1, 75.11
See application file for complete search history.

(56) References Cited

U.S. PATENT DOCUMENTS

| | | | | |
|---|---|---|---|---|
| 5,092,400 | A | 3/1992 | Jagert | |
| 5,727,631 | A * | 3/1998 | Baker et al. | 166/379 |
| 6,688,386 | B2 | 2/2004 | Cornelssen et al. | |
| 6,715,554 | B1 * | 4/2004 | Cunningham et al. | 166/348 |
| 6,851,478 | B2 | 2/2005 | Cornelssen et al. | |
| 2002/0134548 | A1 | 9/2002 | Lam et al. | |
| 2004/0112604 | A1 | 6/2004 | Milberger et al. | |
| 2004/0154790 | A1 | 8/2004 | Cornelssen et al. | |

FOREIGN PATENT DOCUMENTS

CA 2310236 A1 12/2001

OTHER PUBLICATIONS

International Search Report and Written Opinion dated Jan. 18, 2008, for PCT Application No. PCT/US2007/017226, filed Aug. 2, 2008.
Select Energy Systems, "Model 2500R Flanged CT Hanger," undated, obtained from http://www.selectesi.com/select_energy/PDFs/01.pdf, 1-pg.

(Continued)

*Primary Examiner*—David J Bagnell
*Assistant Examiner*—Brad Harcourt
(74) *Attorney, Agent, or Firm*—Zarian Midgley & Johnson PLLC

(57) ABSTRACT

A Christmas tree is used between production tubing elevation and flow line elevation. The tree has a lower portion, an intermediate portion, and an upper portion. The intermediate portion is positioned between the production tubing elevation and the flow line elevation and has an axial dimension configured to substantially maintain the axial dimension between the elevations. The intermediate portion has first and second shut-off valves for closing fluid communication of the axial bore. A hanger is positioned in the axial bore of the intermediate portion between the first and second shut-off valves. The hanger defines a bore and a port. The port communicates a side of the hanger with the lower end of the hanger. The coil tubing attaches to the port at the lower end of the hanger, and the port at the side of the hanger communicates with the feed line of the intermediate portion.

36 Claims, 10 Drawing Sheets

OTHER PUBLICATIONS

Select Energy Systems, "Model 2500 Flanged CT Hanger," undated, obtained from http://www.selectesi.com/select_energy/PDFs/04.pdf, 1-pg.

Select Energy Systems, "Installation Procedure: Model 2500 CT Hanger," undated, obtained from http://www.selectesi.com/select_energy/PDFs/02.pdf, 2-pgs.

PEDCOR, "Series 10-400 Chemical Injector Adaptor," dated Jan. 5, 1995, 1-pg.

PEDCOR, "RF Hanger from PEDCOR Inc in Houston, Texas which designs and manufactures coiled tubing tools, downhole tools, wellhea . . . ," generated on Apr. 21, 2006, obtained from http://www.pedcor.com/wellhead-equipment/rf_hanger.html, 3-pgs.

PEDCOR, "Wellhead Equipment Sub: Standard Hanger," generated on Apr. 21, 2006, obtained from http://www.pedcor.com/wellhead-equipment/standard_mandrel_hanger.html, 3-pgs.

PEDCOR, "Conventional DHSV Coiled Tubing Completion from PEDCOR Inc in Houston, Texas which designs and manufactures coiled . . . ," generated on Apr. 21, 2006, obtained from http://www.pedcor.com/wellhead-equipment/conventional_dhsv_ct_completion.html Apr. 21, 2006, 3-pgs.

International Preliminary Report on Patentability (Chapter I of the Patent Cooperation Treaty) from corresponding PCT Application No. PCT/US2007/017226.

* cited by examiner

MODIFIED CHRISTMAS TREE COMPONENTS AND ASSOCIATED METHODS FOR USING COILED TUBING IN A WELL

FIELD OF THE DISCLOSURE

The subject matter of the present disclosure generally relates to modified Christmas tree components and associated methods for using coiled tubing in oil and gas wells.

BACKGROUND OF THE DISCLOSURE

Referring to FIG. 1A, a Christmas tree 10 according to the prior art is illustrated in an elevational view. The Christmas tree 10 is attached atop conventional components of a wellhead known in the art. The tree 10 includes a tubing head 12, a tubing head adapter 16, a lower master gate valve 18, an upper master gate valve 20, and a flow tee 22. The flow tee 22 has a flow line gate valve 24 and a kill line gate valve 26. The gate valves 24 and 26 connect to additional components (e.g., piping) situated at a flow line elevation FE. The flow line elevation FE is measured from a production elevation, which can be measured from the top of the tubing head adapter 16 (e.g., production elevation PE) or measured from the bottom of the tubing head 12 (e.g., alternate production elevation $PE_{ALT}$). As shown in FIG. 1, the lower shut-off valve 18 and upper shut-off valve 20 are separate components.

The tree 10 is shown with a coil tubing assembly 40 attached atop the flow tee 22. To attach this assembly 40, an upper cap (not shown) that is initially attached atop the flow tree 22 is removed, and the coil tubing assembly 40 is attached to the flow tree 22. Then, coil tubing (also known as capillary) 30 is inserted through the vertical bore 28 that extends through the valves 18 and 20 of the tree 10. During operation, the coil tubing 30 is used to inject chemicals, to carry downhole sensors, or to perform a variety of other purposes. The coil tubing 30 typically has a diameter of ¼ or ⅜ inch.

As is recognized in the art, the coil tubing 30 when inserted in the vertical bore 28 can interfere with the valves 18 and 20 during an emergency shut off. For example, the coil tubing 30 may be severed by a closing shut off valve 18 or 20 so that communication between the vertical bore 28 of the tree 10 and the lower portions of the well (not shown). Severing the coil tubing 30 may cause damage to the valve 18 or 20 and could leave lower portions of the tubing 30 and any sensors or other components lost in the well.

One solution to the problems caused by running the coil tubing 30 through the vertical bore 28 and both valves 18 and 20 involves using a flanged coil tubing hanger between the valves 18 and 20. One example of such a prior art flanged coil tubing hanger 45 is illustrated in an elevational view in FIG. 1B. The flanged coil tubing hanger 45 is inserted between the lower master gate valve 18 and the upper master gate valve 20 to modify the Christmas tree arrangement 10 of FIG. 1A. The flanged coil tubing hanger 45 has flanged ends that connect to the flanged ends of the gate valves 18 and 20. By adding the flanged hanger 45, the resulting Christmas tree arrangement 11 of FIG. 1B has a new flow line elevation $FE_{NEW}$ that is higher than the pre-existing flow line elevation FE. Thus, when the conventional Christmas tree arrangement 10 (as shown in FIG. 1A) is modified to add the flanged coil tubing hanger 45, additional components surrounding the modified Christmas tree arrangement 11 of FIG. 1B must be altered so that the flow lines will properly align with the gate valves 24 and 26 at the new flow line elevation $FE_{NEW}$. The need to modify surrounding components can increase costs and may require additional time for a crew to complete the work.

Another solution to the problems caused by running the coil tubing 30 through both valves 18 and 20 involves using a Y-body Christmas tree. One example of such a prior art Y-body Christmas tree 50 is illustrated in a perspective view and a partial cross-sectional view in FIGS. 2A and 2B, respectively. This Y-body Christmas tree 50 is disclosed in U.S. Pat. No. 6,851,478. The Y-body tree 50 has a body 60 formed as a single piece of steel that has a vertical bore 61 extending axially therethrough. The body 60 connects to a first shut-off valve 52 that is attached to the tubing head adapter 16 and the tubing head 12. The body 60 houses a second shut-off valve 62 for opening and closing the vertical bore 61. The body 60 also has gate valves 64 and 66 attached to an upper, flow tee portion 63 of the body 60 that communicate with the vertical bore 61. At the top of the vertical bore 61, the body 60 has a top cap 14 attached.

A coil tubing bore 70 formed in the body 60 connects to the vertical bore 61 below the upper shut-off valve 62 in the body 60. The coil tubing bore 70 extends upwardly at an angle from the vertical bore 61 so that coil tubing 80 can be fed through the coil tubing bore 70. A coil tubing head assembly 72 is attached to the coil tubing bore 70 so that the coil tubing 80 can be inserted and suspended through the lower shut-off valve 52 and not the upper shut-off valve 62.

The Y-body tree 50 can be added to an existing implementation such that the overall distance between the adapter 16 and the gate valves 64 and 66 at the upper, flow tee portion 63 is not changed. This has the advantage of not requiring additional labor to reconfigure other portions of an implementation. Despite the advantages provided by the Y-body tree 50, there are some disadvantages, as discussed below.

The Y-body tree 50 requires that the body 60 be intricately constructed and integrally formed, which can increase costs. In addition, the coil tubing bore 70 requires that the gate valves 64 and 66 be offset at 90-degrees from one another. In addition, if the upper shut-off valve 62 is closed and the lower shut-off valve 52 is not closed for whatever reason, the coil tubing bore 70 enables pressure from the vertical bore 61 to communicate above the upper shut-off valve 62, which may be undesirable. Furthermore, the coil tubing bore 70 may be prone to damage because it projects outwardly and upwardly from the majority of the Y-body tree 50. For example, the coil tubing bore 70 during operation and use can be exposed to damage caused by objects either falling or being moved around the Y-body tree 50.

The subject matter of the present disclosure is directed to overcoming, or at least reducing the effects of, one or more of the problems set forth above.

BRIEF DESCRIPTION OF THE DRAWINGS

The foregoing summary, preferred embodiments, and other aspects of subject matter of the present disclosure will be best understood with reference to a detailed description of specific embodiments, which follows, when read in conjunction with the accompanying drawings, in which.

Figure 1A:
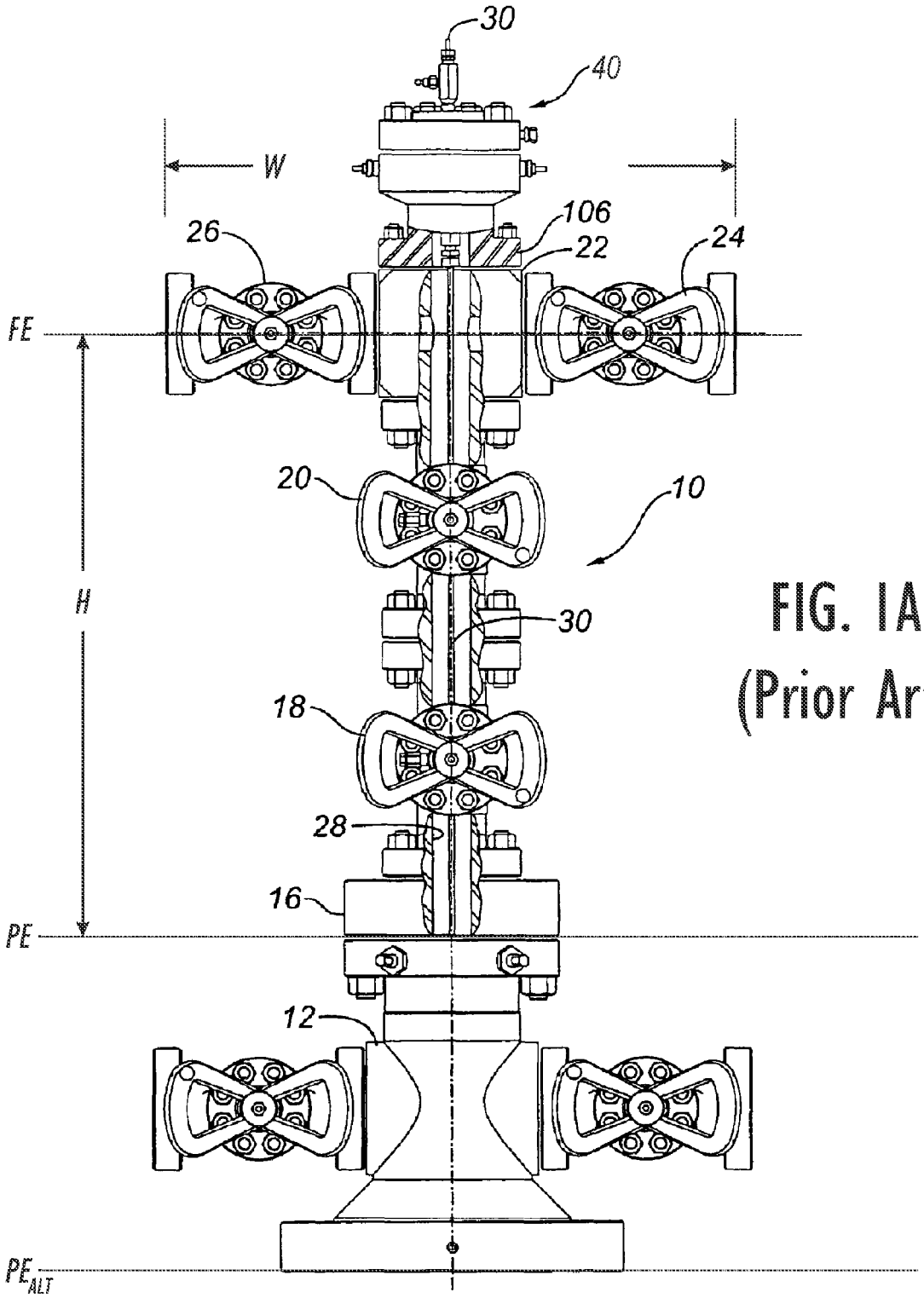
FIG. 1A (Prior Art)
FIG. 1A illustrates an elevational view of a Christmas tree having a coiled tubing hanger according to the prior art.

While the subject matter of the present disclosure is susceptible to various modifications and alternative forms, specific embodiments thereof have been shown by way of example in the drawings and are herein described in detail. The figures and written description are not intended to limit the scope of the inventive concepts in any manner. Rather, the figures and written description are provided to illustrate the inventive concepts to a person skilled in the art by reference to particular embodiments, as required by 35 U.S.C. §112.

SUMMARY OF THE DISCLOSURE

A Christmas tree is used between a production tubing elevation and a flow line elevation where the elevations define a first axial dimension therebetween. The tree has a lower portion, an intermediate portion, and an upper portion. The lower portion can include an adapter at the production tubing elevation that is coupled to a tubing head. The upper portion can include gate valves attached to flow line at the flow line elevation and can include a top cap.

The intermediate portion is positioned between the production tubing elevation and the flow line elevation and has a second axial dimension configured to substantially maintain the first axial dimension between the production tubing elevation and the flow line elevation. The intermediate portion defines an axial bore for communicating the production tubing elevation with the flow line elevation and defines a feed line extending from outside the intermediate portion to the axial bore. One end of the intermediate portion is positioned adjacent the production tubing elevation, and another end is positioned adjacent the flow line elevation. The intermediate portion has first and second shut-off valves for closing fluid communication of the axial bore.

A hanger is positioned in the axial bore of the intermediate portion between the first and second shut-off valves. The hanger defines a bore and a port. The bore communicates portion of the axial bore at an upper end of the hanger with portion of the axial bore at the lower end of the hanger. The port communicates a side of the hanger with the lower end of the hanger. The coil tubing attaches to the port at the lower end of the hanger, and the port at the side of the hanger communicates with the feed line of the intermediate portion. The intermediate portion has a second axial dimension configured to substantially maintain the first axial dimension between the production tubing elevation and the flow line elevation.

A method for modifying a Christmas tree is also disclosed. To modify the Christmas tree, the lower shut-off valve of the Christmas tree is closed, and components of the Christmas tree are removed from above the lower shut-off valve. The removed components include the upper shut-off valve, the flow tee, and the gate valves. One or more modified components are connected to the lower shut-off valve.

In one embodiment, an end of a new valve housing having the new upper shut-off valve is connected to the existing valve housing of the lower shut-off valve. Then, the flow tee is connected to another end of the new valve housing, and the gate valves are connected to the flow tee. In another embodiment, one end of a new integral housing is connected to the existing valve housing of the lower shut-off valve. The new integral housing has the new upper shut-off valve integrally formed with a flow tee. The gate valves are then connected to the flow tee of the new integral housing. When connecting the one or more modified components to the lower shut-off valve, the existing distance between a flow line elevation and a production elevation of the Christmas tree is maintained so that additional modifications (e.g., modifying the elevation of flowlines) are not required.

After connecting the components for the Christmas tree, coiled tubing is connected to a hanger, and the coiled tubing is passed through the new upper shut-off valve and the lower shut-off valve. The hanger is then landed between the new upper shut-off valve and the lower shut-off valve so that the coiled tubing extends through the lower shut-off valve but not the new upper shut-off valve. The coiled tubing is then communicated with a port defined in the one or more modified components adjacent the hanger. For example, the new valve housing for the new upper shut-off valve has the port in its side communicating with the hanger positioned in an axial bore of the valve housing.

In the embodiment having the integral housing, the hanger can be landed on a shoulder integrally formed in the bore of the new integral housing. In the embodiment having the new valve housing, the hanger can be landed on a shoulder formed between a larger bore of the new valve housing and a smaller bore of the existing valve housing of the lower shut-off valve or can be landed on an integral shoulder formed in the bore of the new valve housing. In alternative embodiments, the hanger is positioned on a pair of lock down pins extending into an axial bore communicating the new upper shut-off valve and the lower shut-off valve.

The foregoing summary is not intended to summarize each potential embodiment or every aspect of the present disclosure.

DETAILED DESCRIPTION

Figure 3A:
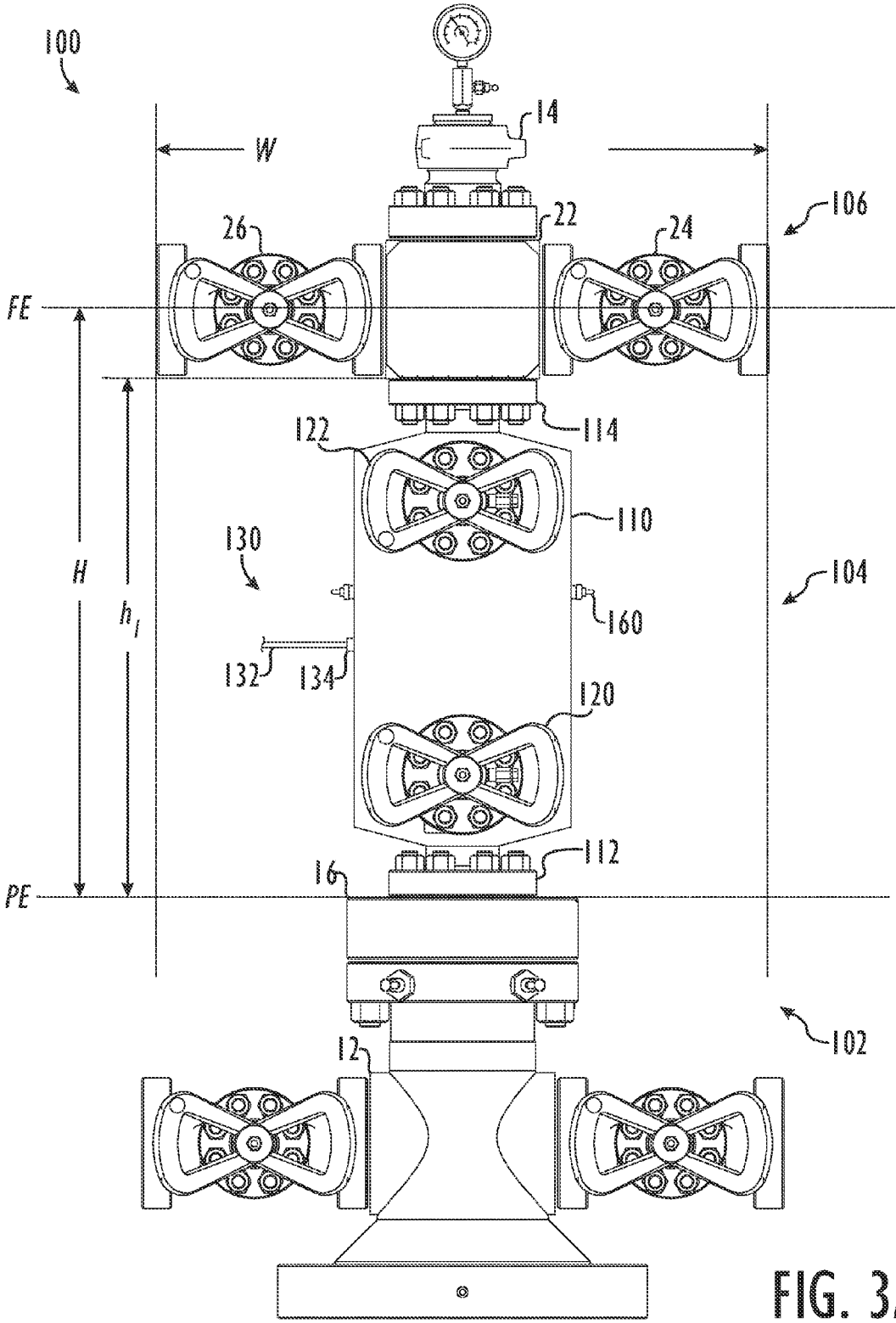
FIG. 3A illustrates an elevational view of an embodiment of a Christmas tree arrangement according to certain teachings of the present disclosure.

Referring to FIG. 3A, an embodiment of a Christmas tree arrangement 100 according to certain teachings of the present disclosure is illustrated in an elevational view. The Christmas tree arrangement 100 has a lower portion 102, an intermediate portion 104, and an upper portion 106. The lower portion 102 includes a tubing head adapter 16 attached to a tubing head 12, as are commonly used. The intermediate portion 104 includes an integral body 110 housing a lower shut-off valve 120 and an upper shut-off valve 122. The upper portion 106 includes a flow tee 22 and includes gate valves 24 and 26 and a top cap 14 that attach to the flow tee 22 in a conventional manner.

Figure 1B:
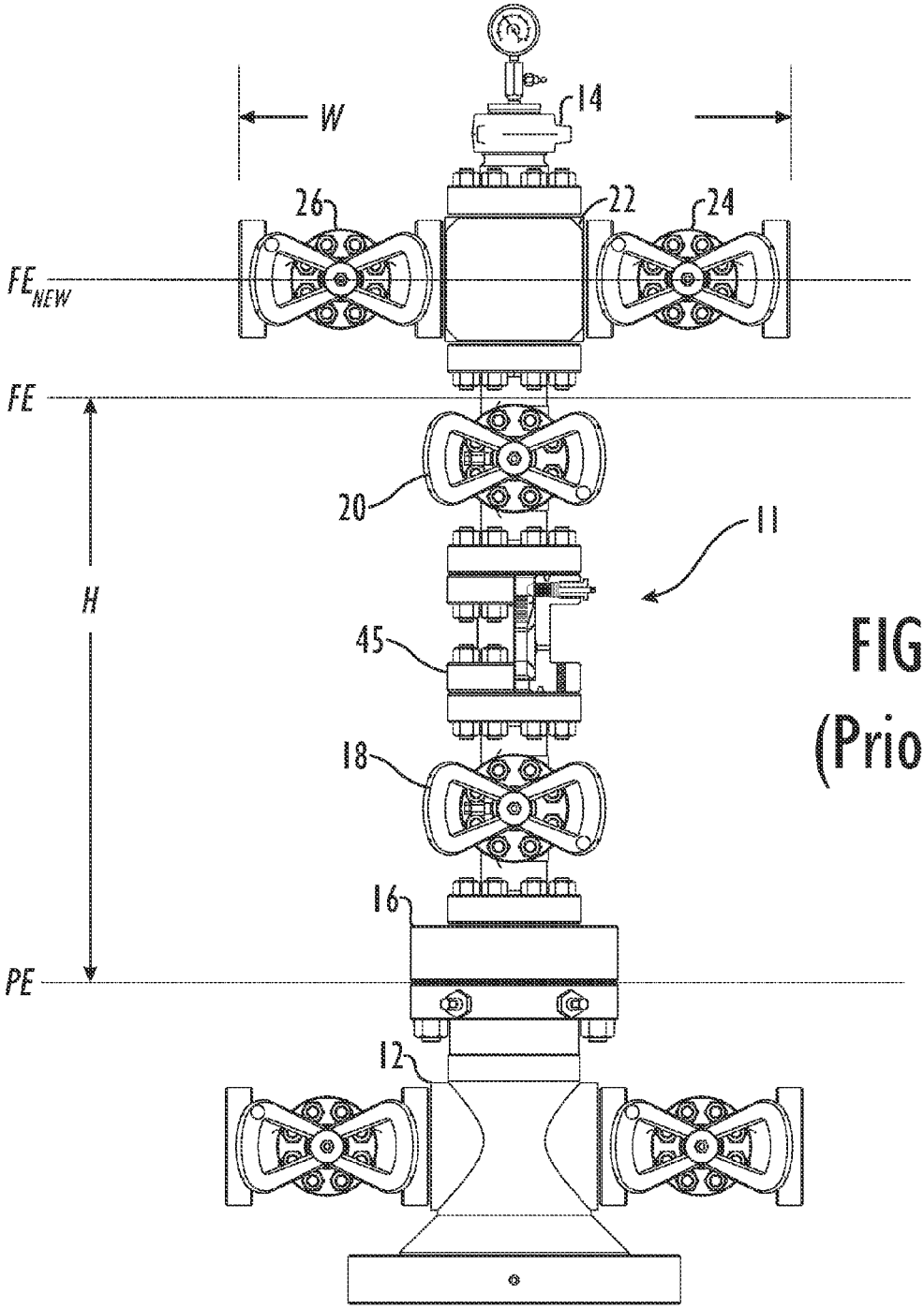
FIG. 1B (Prior Art)
FIG. 1B illustrates an elevational view of another Christmas tree having a flanged coil tubing hanger according to the prior art.

The integral body 110 of the intermediate portion 104 has a lower flange 112 that couples to the tubing head adapter 16. The integral body 110 also has an upper flange 114 onto which the flow tee 22 attaches. The axial dimension h, of the integral body 110 is configured so as to substantially maintain the axial dimension H between the flow line elevation FE (e.g., the line passing through the gate valves 24 and 26 and the flow tee 22) and the production tubing elevation PE (e.g., the top of the tubing head adapter 16). Maintaining this axial dimension H can have several advantages, such as reducing the need for additional labor to reconfigure other aspects of an implementation around the Christmas tree 100. As also shown in FIG. 3A, the integral body 110 also substantially maintains the overall lateral dimension W between ends of the gate valves 24 and 26 as commonly found in prior art Christmas tree arrangements, such as shown in FIG. 1. Although the integral body 110 of FIG. 3A is shown as a unitary component that houses both upper and lower shut-off valves 120 and 122, an alternative embodiment of the integral body 110 may include two components that separately house one of the shut-off valves 120 and 122 and that couple together at a point between the upper and lower shut-off valves 120 and 122 using flanges or the like.

The Christmas tree arrangement 100 also includes a coil tubing assembly 130, only portions of which are visible in the elevational view of FIG. 3A. The coil tubing assembly 130 includes a feed line 132 having a connector 134 attached to the outside of the integral body 110 at a position approximately between the upper and lower shut-off valves 120 and 122. Two lock down pins 160 are positioned in opposing sides of the integral body 110 to hold additional portions (shown in FIG. 3B) of the coil tubing assembly 130 within the body 110. Details related to gland nuts, washers, packing, and fluid seals for the lock down pins 160 will be apparent to one skilled in the art and are not discussed in detail herein.

Figure 3B:
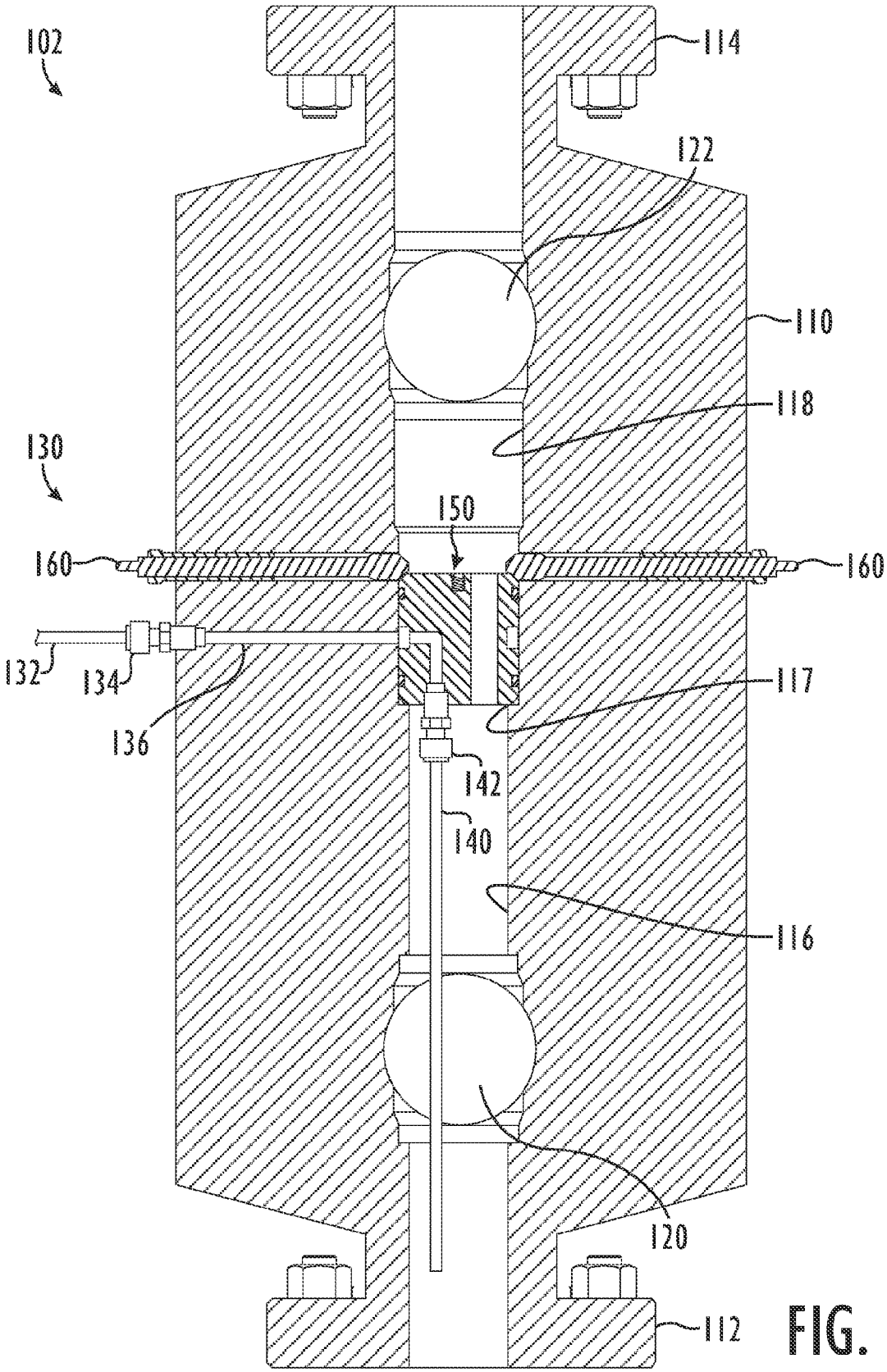
FIG. 3B illustrates a cross-sectional view of an integral body for the Christmas tree arrangement of FIG. 3A.

Turning to FIG. 3B, the integral body 110 of the Christmas tree arrangement 100 of FIG. 3A is illustrated in an isolated, cross-sectional view. In FIG. 3B, additional components of the coil tubing assembly 130 are shown and include a communication channel 136, coil tubing 140, a connector 142, and a hanger 150 in addition to the feed line 132, connector 134, and lock down pins 160 previously mentioned.

The integral body 110 defines a lower bore 116 and an upper bore 118 that communicate from one end 112 of the body 110 to the other end 114. The upper bore 118 defines a greater diameter than the lower bore 116 such that a shoulder 117 is created between the two bores 116 and 118. The hanger 150 is positioned within the upper bore 118 and resets against the shoulder 117. In the present embodiment, the hanger 150 is a removable component that can be inserted and removed from the bore 118 by passing the hanger 150 in and out of the upper bore 118 and flow tee (22; FIG. 3A) when the top cap (14; FIG. 3A) has been removed.

The coil tubing 140 is attached to the hanger 150 by the connector 142 so that the tubing 140 hangs and extends down through the Christmas tree and further into other portions of the well assembly (not shown). For example, the coil tubing 140 may extend for about 10,000-ft. within the well. The lock down pins 160 are threaded into locking ports 162 on opposing sides of the integral body 110 so that ends of the pins 160 engage the hanger 150 to hold it against the shoulder 117.

The hanger 150 allows the lower bore 116 to communicate with the upper bore 118 and allows the feed line 132 and port 136 to communicate with the hanging coil tubing 140. For the benefit of further discussion, the hanger 150 is shown in a detailed, cross-sectional view in FIG. 4A within a portion of the integral body 110. The hanger 150 has a substantially cylindrical body 152 defining a bore 154 therethrough. A threaded opening 153 in the upper end of the cylindrical body 152 allows the hanger 150 to be positioned into and removed from the upper bore 118 of the body 110 by a running rod (not shown). The lower end of the hanger 150 engages the shoulder 117 formed between the upper and lower bores 116 and 118 of the integral body 110. Outside edges at the upper end of the hanger 150 are chamfered so as to be engage by angled tips 161 of the lock down pins 160 in the locking ports 162.

Preferably, the upper bore 118 has a first bore portion 118*a* with a slightly greater diameter than the second bore portion 118*b*. The second bore portion 118*b* with the tighter diameter is where the hanger 150 positions when landed on the shoulder 117 and where the O-rings 157 engage the inner wall of the second bore portion 118*b*. The upper bore portion 118*a* has a slightly lager diameter so that the hanger 150 can be lowered into position in the second bore portion 118*b* without significantly engaging the O-rings 157 or the sides of the hanger 150 with the first bore portion 118*a*.

In the hanger 150, the bore 154 provides fluid communication between the upper and lower bores 116 and 118 of the integral body 110 while the hanger 150 is positioned in the integral body 110. As best shown in the top view of the hanger 150 of FIG. 4B, the bore 154 is preferably C-shaped, and the threaded opening 153 is preferably centered in the hanger 150 to facilitate lowering and lifting the hanger 150 in the bore 118. With respect to fluid communication for the coil tubing assembly 130, the hanger 150 defines an annular channel 156 situated on the outside of the cylindrical body 152 and situated between two O-ring channels 157. The feed port 136, which is defined laterally through the integral body 110, communicates with the annular channel 156 of the hanger 150 regardless of which way the hanger 150 is situated in the bore 118. O-rings in the O-ring channels 157 engage inside walls of the upper bore 118 to prevent fluid communication between the bore 118 and the annular channel 156. An internal port 158 within the hanger 150 communicates the annular channel 156 with a connection opening at the bottom of the body 152 where the connector 142 attaches the coil tubing 140 to the hanger 150. One skilled in the art will appreciated that slips (not shown) may need to be integrated into the hanger 150 to handle the weight of the hanging tubing 140.

Although the hanger 150 in the present embodiment is held in position by lock down pins 160 at an upper end and the shoulder 117 at the lower end, another embodiment of the integral body 110 may lack the shoulder 117 formed by the differently sized bores 116 and 118. Rather, the integral body 110 may have a substantially uniform bore, and two sets of lock down pins 160 (i.e., one set above and one set below) may be used to hold the hanger 150 within the uniform bore.

Figure 4A:
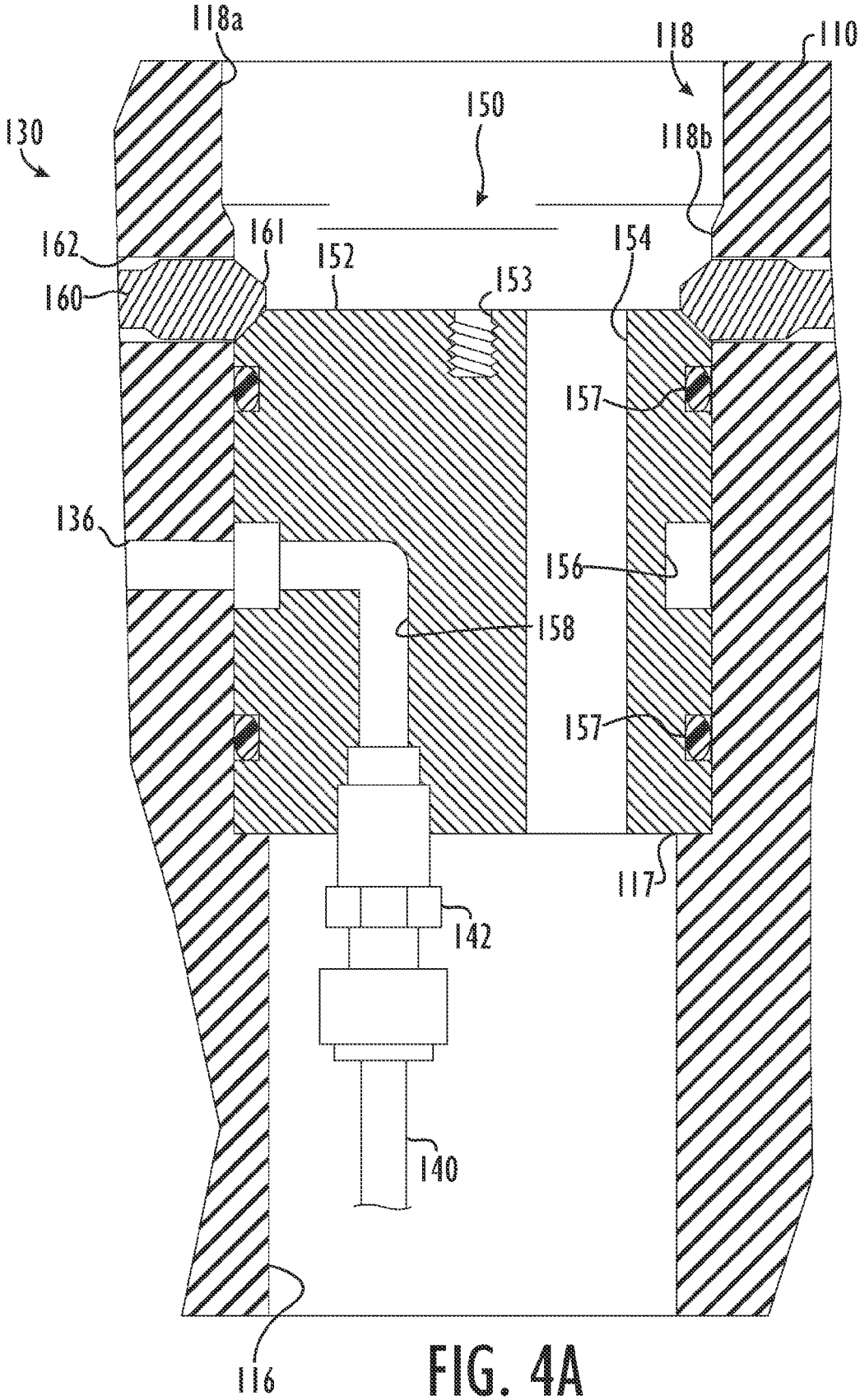
FIG. 4A illustrate a detail cross-sectional view of a hanger according to the present disclosure as used in the integral body of FIG. 3B.
Figure 4B:
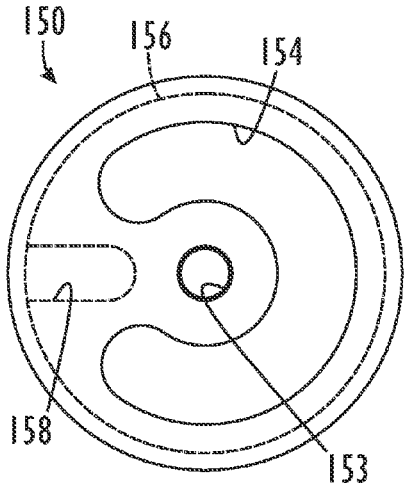
FIG. 4B illustrates a top view of the hanger of FIG. 4A.
Figure 5A:
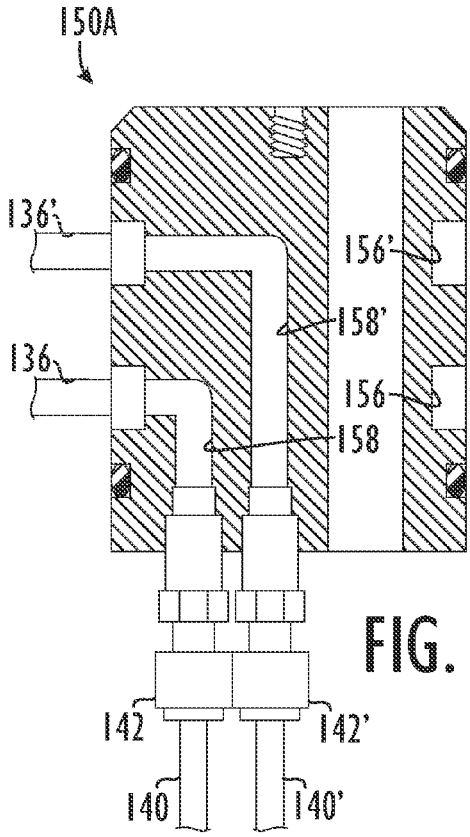
FIGS. 5A-5B illustrate alternative embodiments of hangers for supporting more than one length of coiled tubing.

The hanger 150 in the embodiment of FIG. 4A-4B has one annular channel 156 that communicates with one internal port 158 for connecting to one length of coil tubing 140. In FIG. 5A, an alternative embodiment of a hanger 150A includes at least one additional annular channel 156' defined around the circumference of the hanger 150A. This additional annular channel 156' communicate with another internal port 158' so that the hanger 150A can support an additional length of coil tubing 140'. The additional coil tubing 140' can have its own coupling 142' to the hanger 150A. For such an embodiment, the integral body or other housing (not shown) supporting the hanger 150A defines an additional feed port 136' for communicating with this additional annular channel 156' so that more than one fluid (e.g., air, foam, hydraulics) can be communicated into the well.

Figure 5B:
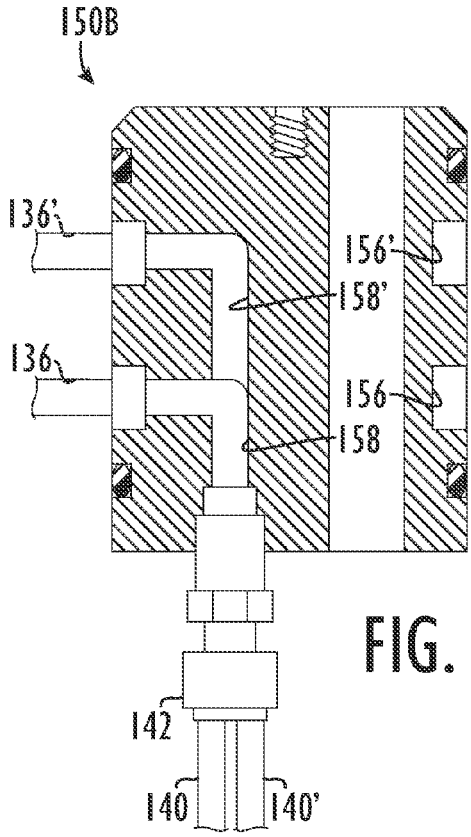

In FIG. 5B, another alternative embodiment of a hanger 150B also includes at least one additional annular channel 156' defined around the circumference of the hanger 150B. This additional annular channel 156' communicate with another internal port 158' so that the hanger 150B can support an additional length of coil tubing 140'. The integral body or other housing (not shown) supporting the hanger 150B defines an additional feed port 136' for communicating with this additional annular channel 156' so that more than one fluid (e.g., air, foam, hydraulics) can be communicated into the well. In this embodiment, the coil tubing 140 and 140' share a common coupling 142' to the hanger 150B. The lengths of coil tubing 140 and 140' can be run adjacent to one another or can be run concentrically with one passing through the other.

The embodiment of the Christmas tree arrangement of FIGS. 3A-3B may be suitable when initially installing components on a rig. Other embodiments of the Christmas tree arrangements disclosed herein may be suitable for retrofitting or modifying existing components of a conventional Christmas tree on a rig so that a coiled tubing system according to the teachings of the present disclosure can be used with the modified Christmas tree arrangements.

Figure 6:
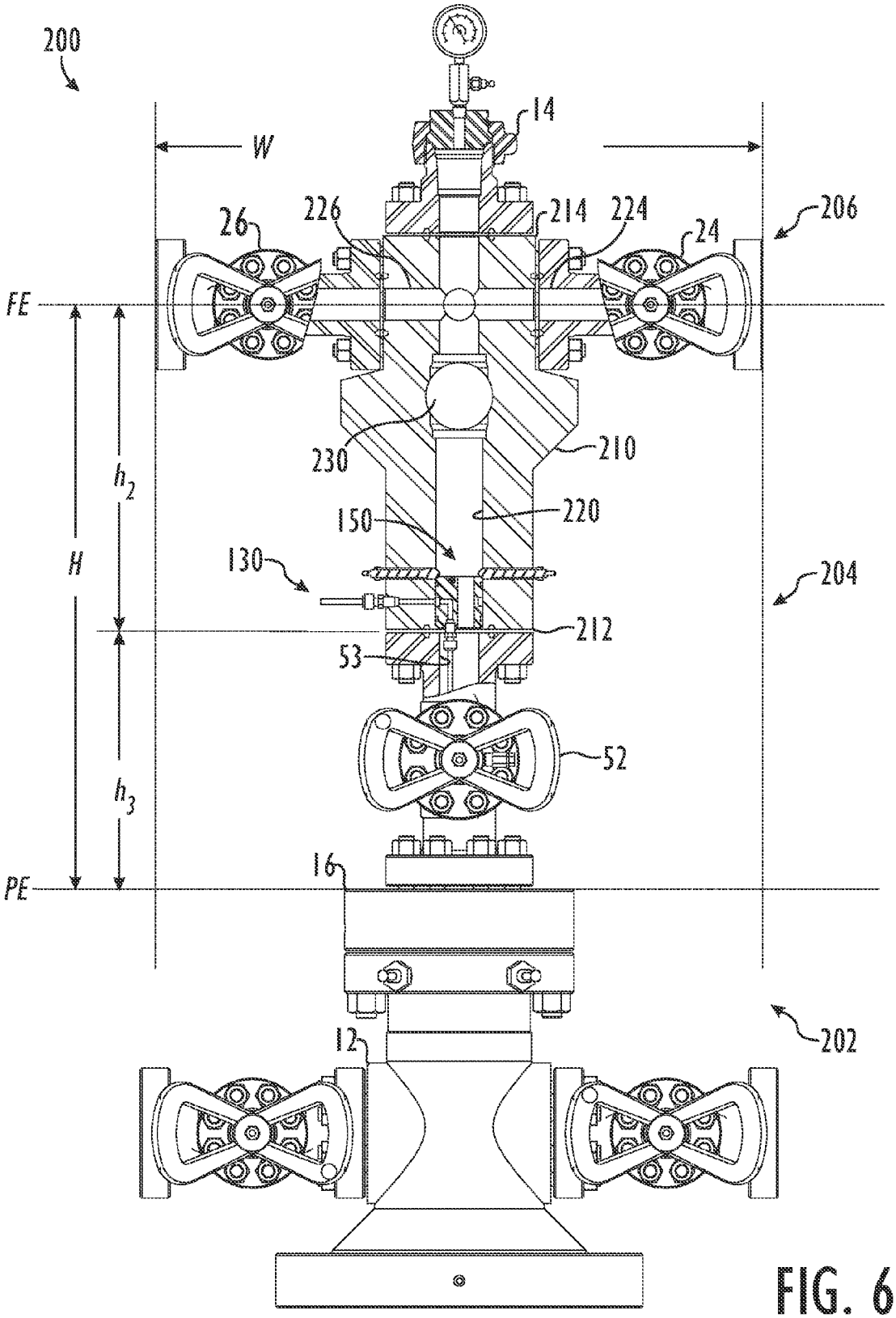
FIG. 6 illustrates an elevation view in partial cross-section of another embodiment of a Christmas tree arrangement according to certain teachings of the present disclosure.

Referring to FIG. 6, another embodiment of a Christmas tree arrangement 200 according to certain teachings of the present disclosure is illustrated in partial cross-section. The Christmas tree arrangement 200 includes a lower portion 202, an intermediate portion 204, and an upper portion 206. The lower portion 202 has an adapter 22 coupled to a tubing head 12. The intermediate portion 204 includes an integral body 210 and a lower shut-off valve 52.

The lower shut-off valve 52 can be a conventional shut-off valve and can be a pre-existing component attached to the tubing head 12 by the adapter 16 of a rig. The present embodiment of the Christmas tree arrangement 200 can be used to retrofit or modify the existing components of a conventional Christmas tree so that the coiled tubing system 130 of the present disclosure can be used on the rig. To modify the conventional Christmas tree, the lower shut-off valve 52 can be closed. Existing components (i.e., flow tee (not shown), upper shut-off valve (not shown), and gate valves 24 and 26) can be removed from the lower shut-off valve 52. The integral body 210 can then be attached to the lower shut-off valve 52, and the gate valves 24 and 26 can be attached to the integral body 210. The resulting Christmas tree arrangement 200 of the present embodiment can then use the coiled tubing system 130.

The integral body 210 houses an upper shut-off valve 230 and has a lower end 212 that couples to the lower shut-off valve 52. The upper portion 206 includes a top cap 14 and gate valves 24 and 26. The integral body 210 also has an integrally formed flow tee portion 214 that forms a flow tee. The gate valves 24 and 26 and the top cap 14 are attached to the flow tee portion 214 in a conventional manner.

The axial dimension $h_2$ of the integral body 210 is configured so that its dimension along with a dimension $h_3$ of the lower valve 52 substantially maintain the axial dimension H between the flow line elevation FE and the production tubing elevation PE commonly found in prior art Christmas tree arrangements, such as shown in FIG. 1. In addition, the integral body 210 also substantially maintains the overall lateral dimension W between ends of the gate valves 24 and 26 as commonly found in prior art Christmas tree arrangements.

The coil tubing assembly 130 of the Christmas tree arrangement 200 is similar to that discussed previously. Again, the coil tubing assembly 130 includes the feed line 132 having the connector 134 attached to the outside of the body 210 at a position approximately between the upper and lower shut-off valves 220 and 52. Two lock down pins 160 are positioned in opposing sides of the body 210 to hold the hanger 150 within the body 210. Other detail related to the hanger 150 and coil tubing assembly 130 are similar to those details discussed previously so that they are not repeated here.

The integral body 210 defines an axial bore 220 that communication the lower end 212 with the flow tee portion 214. The bore 220 at the flow tee end 214 is closed off by the top cap 14 and communicates with side channels 224 and 226 for the gate valves 24 and 26, respectively. In one embodiment and as shown in FIG. 6, the diameter of the axial bore 220 is greater than the diameter of the bore 53 of the lower shut-off valve 52 so that the hanger can rest on a shoulder formed between the bores 220 and 53. In another embodiment, the axial bore 220 may have two portions with different diameters such that a shoulder for the hanger 150 is formed at an appropriate point below the upper shut-off valve 230. In addition, the axial bore 220 preferably has a slightly smaller diameter at the portion of the bore 220 where the hanger 150 lands, as discussed previously. In either case, the hanger 150 is removable and can be used to position coiled tubing in the well. In addition, the hanger 150 allows the bore 53 of the lower shut-off valve 52 to communicate with the axial bore 220 of the body 210 and allows the feed line 132 and port 138 to communicate with the hanging coil tubing in a manner similar to that disclosed above.

Figure 7A:
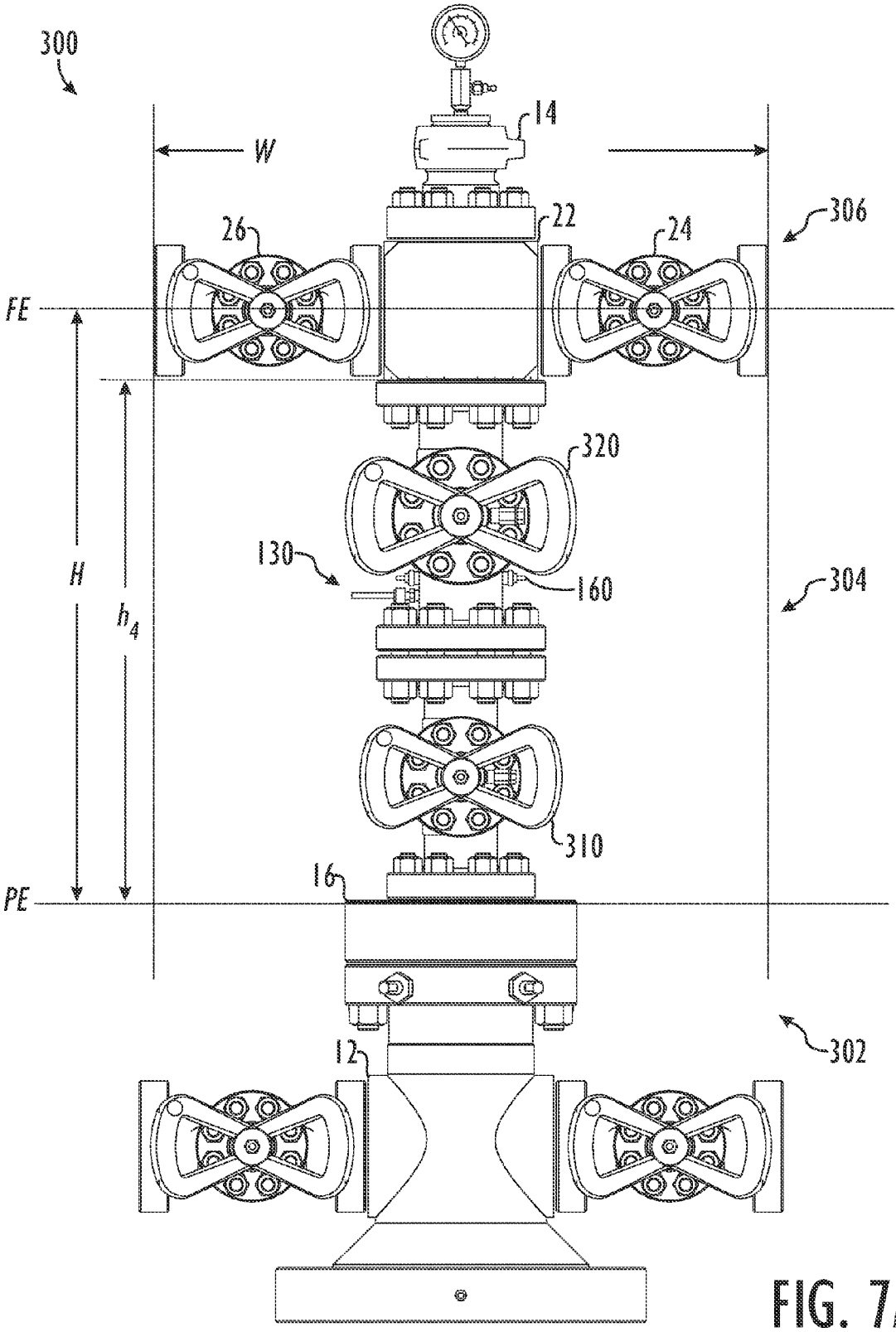
FIG. 7A illustrates an elevation view of yet another embodiment of a Christmas tree arrangement according to certain teachings of the present disclosure.

Referring to FIG. 7A, yet another embodiment of a Christmas tree arrangement 300 according to certain teachings of the present disclosure is illustrated in an elevational view. The Christmas tree arrangement 300 includes a lower portion 302, an intermediate portion 304, and an upper portion 306. The lower portion 302 has an adapter 12 and a tubing head 16 as discussed previously. The upper portion 304 has a flow tee 22, top cap 14, and gate valves 24 and 26, as discussed previously. The intermediate portion 304 has a lower shut-off valve 310 and an upper shut-off valve 330. The upper shut-off valve 320 is lager than the lower shut-of valve 310 for reasons discussed below.

In one embodiment, the adapter 12, the tubing head 16, the flow tee 22, the top cap 14, and the gate valves 24 and 26, and the lower shut-off valve 310 are components of a conventional Christmas tree, and the present embodiment of the Christmas tree arrangement 300 represents a modification of that conventional Christmas tree. To modify the conventional Christmas tree, for example, the lower shut-off valve 310 can be closed, and the flow tee 22, the top cap 14, the gate valves 24 and 26, and a pre-existing upper shut-off valve (not shown) can be removed from the lower shut-off valve 310. Then, the modified upper shut-off valve 320 of the present embodiment can be attached to the existing lower shut-off valve 310, and the existing flow tee 22, top cap 14, and gate valves 24 and 26 can be connected to the newly added upper shut-off valve 320. In this way, existing components of the conventional Christmas tree of a rig can be retrofitted or modified for use with the coiled tubing system 130 of the present disclosure.

The coil tubing assembly 130 is similar to that discussed previously so that details are not repeated here. Furthermore, the Christmas tree arrangement 300 substantially maintains the axial dimension H between the flow line elevation FE and the production tubing elevation PE and substantially maintains the overall lateral dimension between ends of the gate valves 24 and 26 as commonly found in prior art Christmas tree arrangements, such as shown in FIG. 1.

Figure 7B:
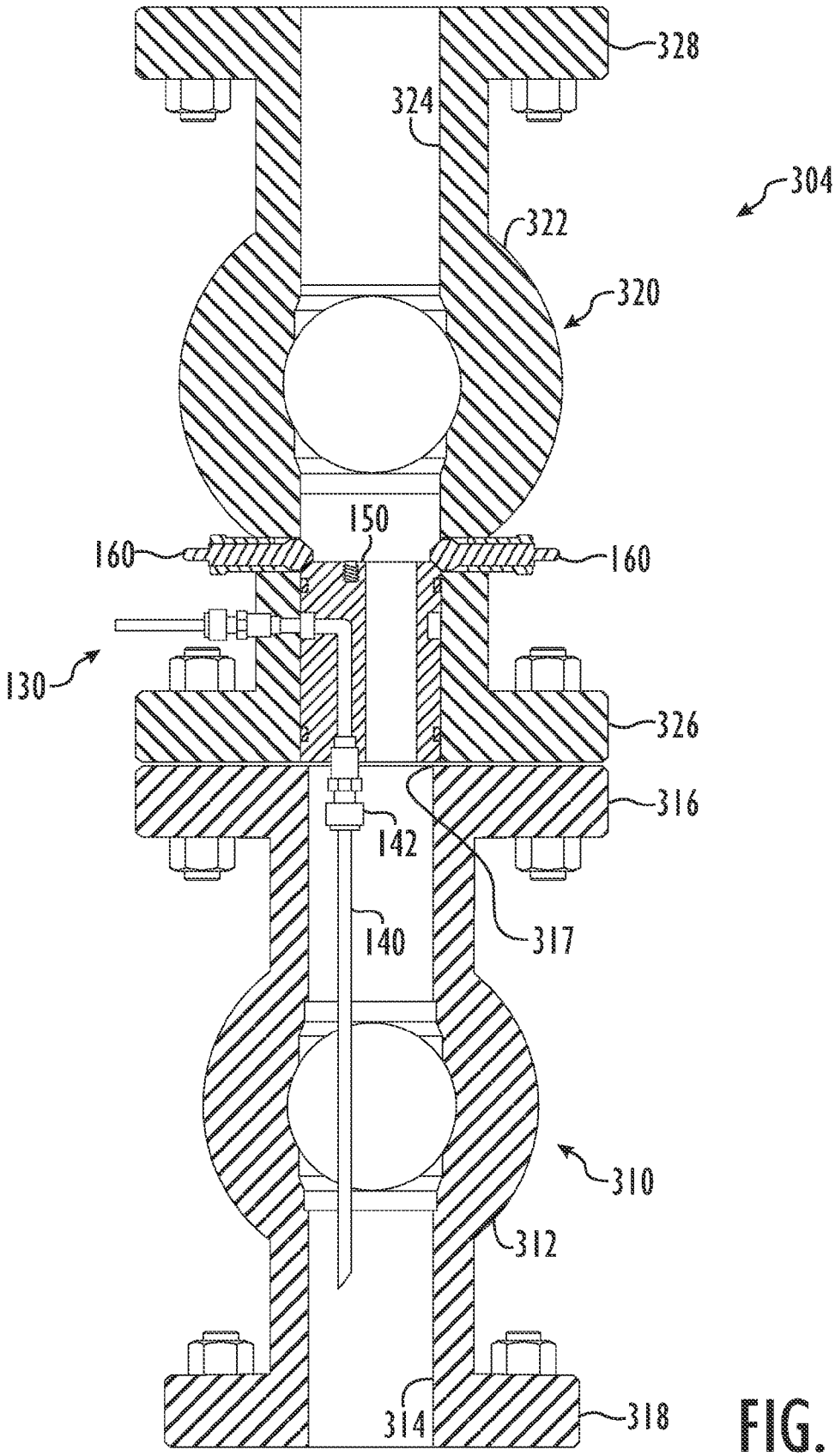
FIG. 7B illustrates a cross-sectional view of two valve bodies for the Christmas tree arrangement of FIG. 7A having a hanger according to the present disclosure.

The upper shut-off valve 320 houses components of the coil tubing assembly 130 as best shown in the cross-sectional view of the upper and lower valve bodies in FIG. 7B. Again, the coil tubing assembly 130 includes a hanger 150, lock down pins 160, feed line 132, coupling 134, coiled tubing 140, coupling 142, and other components similar to those discussed in previous embodiments.

The lower shut-off valve 310 has a valve body 312 that houses components (not shown) of the valve 310. The valve body 312 defines an axial bore 314 that extends from an upper flange 316 to a lower flange 318. Similarly, the upper shut-off valve 320 has a valve body 322 that houses components (not shown) of the valve 320. The valve body 322 defines an axial bore 324 that extends from a lower flange 326 to an upper flange 328.

Because the upper shut-off valve 320 is lager than the lower shut-off valve 310, a shoulder 317 is created between the larger bore 324 of the upper valve 320 and the smaller bore 314 of the lower valve 310. Again, the bore 324 preferably has a slightly smaller diameter at the portion of the bore 324 where the hanger 150 lands, as discussed previously. The hanger 150 rests against the shoulder 317 and is held in place by the lock down pins 160 positioned in opposing sides of the upper valve body 322. In one implementation, for example, the bore 324 of the upper shut-off valve 320 may have an internal diameter of about 2 9/16-in. while the bore 314 of the lower shut-off valve 310 may have an internal diameter of about 2 1/16-in. In general, the upper shut-off valve 320 is about "one size" larger than the lower shut-off valve 310. For example, this "one size" difference can be determined based on the exemplary sizing chart provided below. Generally, shut-off valves for offshore implementations are rated for 5,000-psi and greater. Therefore, the smallest nominal dimension may preferably be 1 13/16-in. (46-mm) as shown by size A in the chart below.

| Size | ID (in.) | ID (mm) |
|---|---|---|
| A | 1 13/16 | 46.0 |
| B | 2 1/16 | 52.4 |
| C | 2 9/16 | 65.1 |
| D | 3 1/16 | 77.8 |
| E | 4 1/16 | 103.2 |
| F | 5 1/8 | 130.2 |
| G | 7 1/16 | 179.4 |
| H | 9 | 228.6 |
| I | 11 | 279.4 |
| J | 13 5/8 | 346.1 |
| K | 16 3/4 | 425.5 |
| L | 18 3/4 | 476.3 |
| M | 21 1/4 | 539.8 |

The sizes in the above chart are meant to be exemplary. The differences in sizes between the two valves 310 and 320 may not affect the overall lateral dimension W of the Christmas tree arrangement 300 of FIG. 7A. However, the difference in sizes may affect the overall axial dimension of the arrangement 300. To ensure that the two valves 310 and 320 of the intermediate portion 302 of FIG. 7A substantially maintain the desired axial dimension H, one or more modifications detail below may need to be performed.

Figure 2A:
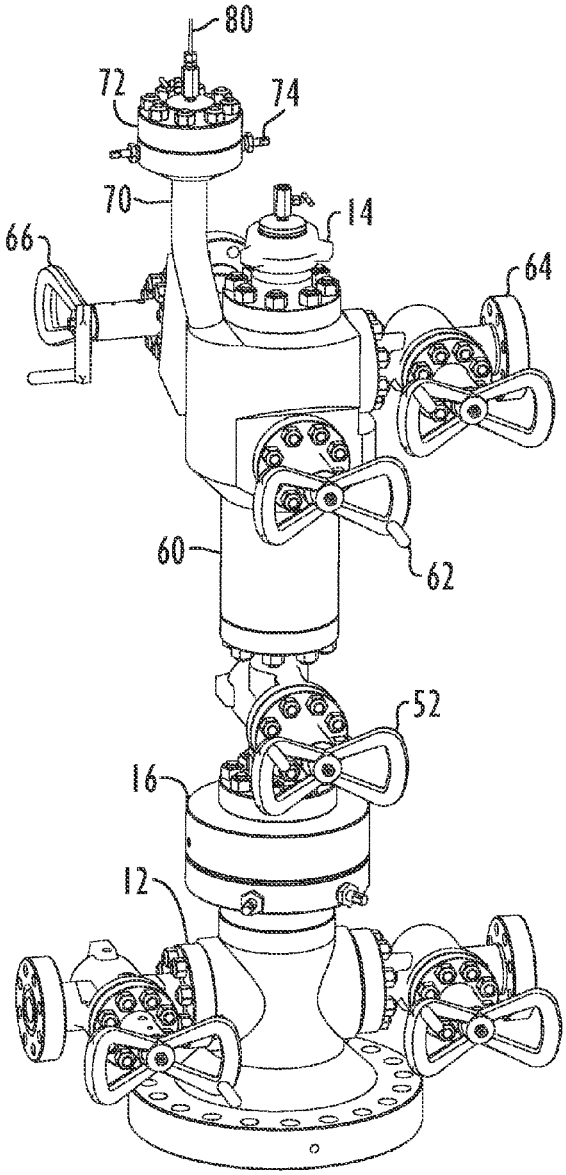
FIG. 2A (Prior Art)
FIG. 2A illustrates a perspective view of a Y-Body Christmas tree having a coiled tubing hanger according to the prior art.
Figure 2B:
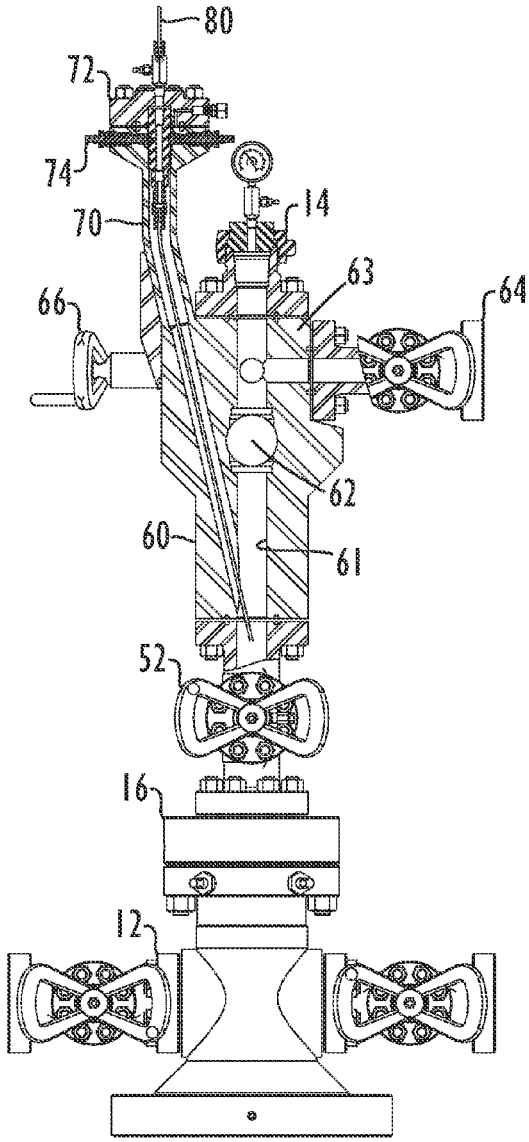
FIG. 2B (Prior Art)
FIG. 2B illustrates a partial cross-sectional view of the prior art Y-body Christmas tree of FIG. 2A.

As shown in FIG. 7B, the diameter of the upper flange 316 of the lower valve 310 may need to be modified so that it can couple with the lager diameter flange 326 of the upper valve 320. The thickness or height of one or more flanges 316, 318, 326, and 328 of the valves 310 and 320 may need to be reduced so that the axial dimension H shown in FIG. 7A can be maintained. In other possible modifications best shown in FIG. 7A, the thickness of the adapter 16 may be reduced or the axial dimension of the flow tee 22 may be modified. Also, the dimensions of the flow-tee 22 where it couples to the upper flange 328 of the second shut-off valve 320 may need to be modified due to the larger diameter of the upper flange 328. The changes and modifications detailed herein can be implemented in various ways, such as by casting new components or machining existing components to meet the modified dimensions. It will be appreciated that using the modified gate valve 320 having the internal landing shoulder 317 and lock down pins 160 is substantially more cost effective than using the "Y-body" Christmas tree of the prior art discussed above in FIGS. 2A-2B.

As discussed in the embodiment of FIGS. 3A and 3B, the disclosed Christmas tree arrangement 100 can have an integral body 110 housing both upper and lower shut-off valves 120 and 120. As discussed in the embodiment of FIG. 6, the disclosed Christmas tree arrangement 200 can have an integral body 210 housing an upper shut-off valve 230 only and can incorporate a flow tee in the integral flow-tee portion 214 of the body 210. Therefore, it will be appreciated with the benefit of the present disclosure that additional embodiments can be implemented that integrally incorporate different valves and other portions of the Christmas tree. Such additional embodiments can still be commensurate with the teachings of the present disclosure such that the disclosed coil tubing assembly 130 and hanger 150 can be used in these additional embodiments. For example, one such additional embodiment can include an integral body that houses both upper and lower shut-off valves and that integrally incorporates portions of a flow-tee. The disclosed coil tubing assembly 130 and hanger 150 can then be used with the integral body of this additional embodiment in a manner similar to that discussed above with reference to FIGS. 3A-3B and 4.

As disclosed herein, the Christmas tree arrangements of the present disclosure are capable of maintaining existing axial dimension H between the production tubing elevation PE and the flow line elevation FE and existing lateral dimension W between flow lines at the flow line elevation FE. Accordingly, embodiments of the Christmas tree arrangement disclosed herein are suitable for retrofitting existing implementations at wells without requiring substantial modifications to existing piping and other components at the wells.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A Christmas tree for use between a production tubing elevation and a flow line elevation, the elevations defining a first axial dimension therebetween, the tree comprising:

an intermediate portion of the Christmas tree positioned between the production tubing elevation and the flow line elevation and defining an axial bore for communicating the production tubing elevation with the flow line elevation, the intermediate portion having a first shut-off valve for closing fluid communication of the axial bore and having a second shut-off valve for closing fluid communication of the axial bore, the intermediate portion defining a feed line extending from outside the intermediate portion to the axial bore at a point between the first and second shut-off valves; and a hanger within the Christmas tree positioned in the axial bore of the intermediate portion between the first and second shut-off valves, the hanger defining a bore and a port, the bore communicating portion of the axial bore at an upper end of the hanger with portion of the axial bore at a lower end of the hanger, the port communicating a side of the hanger with the lower end of the hanger, the port at the side of the hanger communicating with the feed line of the intermediate portion, a coil tubing attaching to the port at the lower end of the hanger, wherein the intermediate portion has a second axial dimension configured to substantially maintain the first axial dimension between the production tubing elevation and the flow line elevation.

2. The Christmas tree of claim 1, wherein first and second flow lines at the flow line elevation define a first lateral dimension therebetween, and wherein the intermediate portion has a second lateral dimension configured to substantially maintain the first lateral dimension between the first and second flow lines.

3. The Christmas tree of claim 1, wherein the hanger is removable from the axial bore.

4. The Christmas tree of claim 1, comprising a lower portion attached to a lower end of the intermediate portion and extending below the production tubing elevation, the lower portion comprising an adapter coupled to a tubing head.

5. The Christmas tree of claim 1, comprising at least one pair of locking pins positioned laterally through the intermediate portion and engaging the hanger within the axial bore.

6. The Christmas tree of claim 1, wherein the intermediate portion comprises an integral body housing both the first shut-off valve and the second shut-off valve and defining a bore therethrough, the hanger positioned within the bore approximately between the first and second shut-off valves.

7. The Christmas tree of claim 6, wherein the integral body comprises a lower flange coupling to a tubing component at the production tubing elevation.

8. The Christmas tree of claim 6, wherein the integral body comprise an upper flange coupling to flow tee at the flow line elevation.

9. The Christmas tree of claim 6, wherein the integral body comprises a flow tee portion integrally formed with the integral body at the flow line elevation, whereby first and second gate valves couple the integral flow tee portion to flow lines at the flow line elevation.

10. The Christmas tree of claim 6, wherein the bore defined through the integral body has an upper portion with a greater diameter than a lower portion, whereby the hanger engages a shoulder formed by the upper and lower portions of the bore.

11. The Christmas tree of claim 1, wherein the intermediate portion comprises:

a valve body for the first shut-off valve having an upper flange and a lower flange and having a first bore with a first diameter, the lower flange attached to a tubing component at the production tubing elevation, and an integral body housing the second shut-off valve and having a second bore with a second diameter greater than the first diameter, the integral body having a lower end coupling to the upper flange of the valve body, the hanger positioned within the second bore and engaging a shoulder formed by the first bore.

12. The Christmas tree of claim 11, wherein the integral body comprise a flow tee portion integrally formed with the body and positioned at the flow line elevation, whereby first and second gate valves couple the integral flow tee portion to flow lines at the flow line elevation.

13. The Christmas tree of claim 1, wherein the intermediate portion comprises:

a first valve body for the first shut-off valve attached to an adapter at the production tubing elevation and having a first size, and a second valve body for the second shut-off valve attached to the first shut-off valve and having a second size greater than the first size, wherein the hanger is positioned in an axial bore of the second valve body.

14. The Christmas tree of claim 1, wherein the flow line elevation is an elevation of a flow tee connected to the immediate portion of the Christmas tree and the production tubing elevation is an elevation of a portion of a tubing head adapter connected to the immediate portion Christmas tree.

15. A Christmas tree for use between a production tubing elevation and a flow line elevation, the elevations defining an axial dimension therebetween, the tree comprising:

means for communicating the production tubing elevation with the flow line elevation through an axial bore and for maintaining the axial dimension between the production tubing elevation and the flow line elevation;

first means for shutting off fluid communication at a first point in the axial bore between the production tubing elevation with the flow line elevation;

second means for shutting off fluid communication at a second point in the axial bore between the production tubing elevation with the flow line elevation;

means for hanging a first end of coiled tubing at an intermediate point in the axial bore between the first and second points, wherein the means for hanging is positioned within the Christmas tree; and means for communicating the first end of the coiled tubing at the intermediate point in the axial bore with another point outside the axial bore.

16. The Christmas tree of claim 15, further comprising means for maintaining a lateral dimension between first and second gate valves at the flow line elevation.

17. The Christmas tree of claim 15, wherein the means for hanging comprises means for removably positioning the first end of the coiled tubing in the axial bore.

18. The Christmas tree of claim 15, wherein the first means for shutting off fluid communication comprises a larger lateral dimension than the second means for shutting off fluid communication.

19. The Christmas tree of claim 15, wherein the first means for shutting off fluid communication comprises means integrally formed for communicating with first and second gate valves at the flow line elevation.

20. The Christmas tree of claim 15, wherein the first and second means for shutting off fluid communication comprise means integrally formed for communicating between the first and second points.

21. The Christmas tree of claim 15, wherein the means for hanging comprise means for communicating an upper portion of the axial bore with a lower portion of the axial bore.

22. The Christmas free of claim 15, wherein the flow line elevation is a elevation of a flow tee and wherein the production tubing elevation is a elevation of a portion of a tubing head adapter.

23. A method for modifying an existing Christmas tree, comprising:

closing a lower shut-off valve of the Christmas tree;

removing components of the Christmas tree from above the lower shut-off valve, the components at least including an upper shut-off valve;

connecting one or more modified components to the lower shut-off valve, the one or more modified components at least including a new upper shut-off valve;

maintaining an existing distance between a flow line elevation and a production elevation of the Christmas tree when connecting the one or more modified components to the lower shut-off valve;

connecting coiled tubing to a hanger;

passing the coiled tubing through the new upper shut-off valve and the lower shut-off valve;

landing the hanger between the new upper shut-off valve and the lower shut-off valve; and communicating the coiled tubing with a port defined in the one or more modified components adjacent the hanger.

24. The method of claim 23, wherein the new upper shut-off valve is larger than the existing lower shut-off valve.

25. The method of claim 23, wherein the act of connecting one or more modified components to the lower shut-off valve comprises:

connecting one end of a new valve housing having the new upper shut-off valve to an existing valve housing of the lower shut-off valve;

connecting a flow tee to another end of the new valve housing; and connecting gate valves to the flow tee, wherein the new valve housing includes the port for communicating with the hanger.

26. The method of claim 25, wherein the new valve housing defines an axial bore that is greater than that of the existing valve housing of the lower shut-off valve such that a shoulder is formed at the connection of the valve housings.

27. The method of claim 25, wherein the new valve housing defines an axial bore having a shoulder for landing the hanger between the new upper shut-off valve and the lower shut-off valve.

28. The method of claim 25, wherein the new upper shut-off valve is larger than the existing lower shut-off valve, and wherein the act of maintaining an existing distance between a flow line elevation and a production elevation of the Christmas tree comprises modifying the new valve housing of the new upper shut-off valve such that the new valve housing defines substantially the same axial dimension as an old valve housing of the existing upper shut-off valve removed from the lower shut-off valve.

29. The method of claim 23, wherein the act of connecting one or more modified components to the lower shut-off valve comprises:

connecting one end of a new integral housing to an existing valve housing of the lower shut-off valve, the new integral housing having the new upper shut-off valve integrally formed with a flow tee; and connecting gate valves to the flow tee of the new integral housing, wherein the new integral housing includes the port for communicating with the hanger.

30. The method of claim 29, wherein the new integral housing defines an axial bore that is greater than that of the existing valve housing of the lower shut-off valve such that a shoulder for landing the hanger is formed at the connection of the new integral housing with the existing valve housing.

31. The method of claim 29, wherein the new integral housing defines an axial bore having a shoulder for landing the hanger.

32. The method of claim 29, wherein the new upper shut-off valve is larger than the existing lower shut-off valve, and wherein the act of maintaining an existing distance between a flow line elevation and a production elevation of the Christmas tree comprises modifying the new integral housing having the new upper shut-off valve and flow tee such that the new valve housing defines substantially the same axial dimension as an old valve housing of the upper shut-off valve and an old flow tee removed from the lower shut-off valve.

33. The method of claim 23, wherein the act of landing the hanger between the new upper shut-off valve and the lower shut-off valve comprises positioning the hanger on a shoulder formed in axial bore communicating the new upper shut-off valve and the lower shut-off valve.

34. The method of claim 23, wherein the act of landing the hanger between the new upper shut-off valve and the lower shut-off valve comprises positioning the hanger on a pair of lock down pins extending into an axial bore communicating the new upper shut-off valve and the lower shut-off valve.

35. A Christmas tree for use between a production tubing elevation and a flow line elevation, the elevations defining a first axial dimension therebetween, the tree comprising:

an intermediate portion positioned between the production tubing elevation and the flow line elevation and defining an axial bore for fluid communication between the production tubing elevation with the flow line elevation, the intermediate portion defining a feed line extending from outside the intermediate portion to the axial bore; and a hanger positioned in the axial bore of the intermediate portion, the hanger defining a bore and a port, the bore in fluidic communication with a first portion of the axial bore at an upper end of the hanger and a second portion of the axial bore at a lower end of the hanger, the port permitting fluidic communication between a side of the hanger with the lower end of the hanger, the port at the side of the hanger being in fluid communication with the feed line of the intermediate portion, a coil tubing attaching to the port at the lower end of the hanger, wherein the intermediate portion has a second axial dimension configure to substantially maintain the first axial dimension between the production tubing elevation and the flow line elevation.

36. A method for modifying an existing Christmas tree, comprising:

removing at least one component of the Christmas tree;

connecting a modified component to the Christmas tree, the modified component having a port permitting fluid communication from a side of the component to an interior axial bore of the Christmas tree;

maintaining an existing distance between a flow line elevation and a production elevation of the Christmas tree when connecting the modified component to the Christmas tree;

connecting coiled tubing to a hanger;

landing the hanger adjacent to the modified component; and hydraulically communicating the coiled tubing with the side of the modified component through the port in the modified component.

* * * * *